US008175499B2

(12) United States Patent
Masui

(10) Patent No.: US 8,175,499 B2
(45) Date of Patent: May 8, 2012

(54) IMAGE FORMING APPARATUS WITH A PLURALITY OF IMAGE FORMING UNITS

(75) Inventor: Naoki Masui, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/156,484

(22) Filed: Jun. 9, 2011

(65) Prior Publication Data

US 2011/0236043 A1 Sep. 29, 2011

Related U.S. Application Data

(63) Continuation of application No. 12/232,142, filed on Sep. 11, 2008, now Pat. No. 7,991,328.

(30) Foreign Application Priority Data

Sep. 27, 2007 (JP) ..... 2007-251389

(51) Int. Cl.
*G03G 15/01* (2006.01)
*G03G 15/20* (2006.01)

(52) U.S. Cl. ..... 399/223; 399/302; 399/320

(58) Field of Classification Search ..... 399/341, 399/342, 320, 223, 299, 302, 38; 430/107.1
See application file for complete search history.

(56) References Cited

U.S. PATENT DOCUMENTS

| | | | | |
|---|---|---|---|---|
| 6,678,493 | B2 * | 1/2004 | Maeyama et al. | 399/302 |
| 7,785,761 | B2 | 8/2010 | Hayashi et al. | |
| 2003/0007814 | A1 * | 1/2003 | Richards | 399/341 |
| 2006/0188301 | A1 * | 8/2006 | Ng et al. | 399/341 |
| 2006/0275058 | A1 * | 12/2006 | Omata | 399/302 |
| 2008/0152389 | A1 * | 6/2008 | Kim | 399/223 |
| 2008/0298860 | A1 | 12/2008 | Omata | |
| 2009/0034998 | A1 * | 2/2009 | Omata | 399/341 X |
| 2009/0041486 | A1 | 2/2009 | Yoshioka et al. | |

FOREIGN PATENT DOCUMENTS

| | | |
|---|---|---|
| JP | 05-249791 A | 9/1993 |
| JP | 2002-072613 | 3/2002 |
| JP | 2002-372882 | 12/2002 |
| JP | 2003-228222 | 8/2003 |

* cited by examiner

*Primary Examiner* — Sophia S Chen
(74) *Attorney, Agent, or Firm* — Kubotera & Associates, LLC

(57) ABSTRACT

An image forming apparatus includes a first image forming unit for forming a color developer image using color developer; a second image forming unit for forming a transparent developer image using transparent developer; a transfer unit for transferring the transparent developer image and the color developer image to a medium; a fixing unit for fixing the transparent developer image and the color developer image; and a control unit for controlling the first image forming unit and the second image forming unit according to a gloss printing operation when the gloss printing operation is selected.

21 Claims, 7 Drawing Sheets

IMAGE FORMING APPARATUS WITH A PLURALITY OF IMAGE FORMING UNITS

CROSS-REFERENCE TO RELATED APPLICATIONS

This is a continuation application of a prior application Ser. No. 12/232,142, filed Sep. 11, 2008, now U.S. Pat. No. 7,991, 328.

BACKGROUND OF THE INVENTION AND RELATED ART STATEMENT

The present invention relates to an image forming apparatus.

In a conventional image forming apparatus such as a printer, a copier, a facsimile, and the likes, image forming units are provided for forming images in yellow, magenta, cyan, and black. In each of the image forming units, a charge roller uniformly charges a surface of a photosensitive drum, and an LED (Light Emitting Diode) head exposes the surface of the photosensitive drum to form a static latent image thereon. Then, a developing roller develops the static latent image, thereby forming a toner image in each color. A transfer roller transfers and overlaps the toner images to a sheet, thereby forming a color toner image. A fixing device fixes the color toner image to the sheet, thereby forming a color image on the sheet.

In general, when toner of each color, i.e., yellow, magenta, cyan, and black, contains a large amount of wax, it is possible to form an image with high gloss. Accordingly, when a photograph is printed in colors, toner of each color containing a large amount of wax is used, thereby making it possible to form a color image having image quality similar to that of the photograph as much as possible. Note that when a photograph is printed in monochrome, it is tried to form a monochrome image having image quality similar to that of the photograph as much as possible.

On the other hand, when a text or a graph is printed, it is preferred to from an image with low gloss. To this end, a conventional printer may be provided with two types of image forming units. One of the image forming units uses black toner containing a small amount of wax, and the other one of the image forming units uses black toner containing a large amount of wax. The printer further includes a plurality of fixing devices having different transfer temperatures (refer to Patent Reference).

Patent Reference Japan Patent Publication No. 2002-372882

In the conventional printer, in order to form both an image with high gloss and an image with low gloss, it is necessary to provide a plurality of the image forming units and a plurality of the fixing devices, thereby making a transportation path of a sheet and a configuration of the printer complicated. Accordingly, it is difficult to cool the printer, thereby increasing a temperature inside the printer. As a result, there may occur problems such as hot offset or uneven fixing in the fixing devices, thereby deteriorating image quality.

In view of the problems described above, an object of the present invention is to provide an image forming apparatus capable of solving the problems of the conventional printer. In the image forming apparatus of the present invention, it is possible to form both an image with high gloss and an image with low gloss, and further to improve image quality.

Further objects of the invention will be apparent from the following description of the invention.

SUMMARY OF THE INVENTION

In order to attain the objects described above, according to an aspect of the present invention, an image forming apparatus includes a plurality of image forming units for forming a developer image on an image supporting member; a transfer unit for transferring and overlapping the developer image on a medium to form a developer laminated portion; and a fixing unit for fixing the developer laminated portion.

In the aspect of the present invention, one of the image forming units uses transparent developer having a softening point higher than that of color developer used in the other of the image forming units, and having an average particle size larger than that of the color developer.

In the aspect of the present invention, the image forming apparatus includes a plurality of the image forming units for forming the developer image on the image supporting member; the transfer unit for transferring and overlapping the developer image on the medium to form the developer laminated portion; and the fixing unit for fixing the developer laminated portion.

Further, in the aspect of the present invention, one of the image forming units uses the transparent developer having the softening point higher than that of the color developer used in the other of the image forming units, and having the average particle size larger than that of the color developer.

When one of the image forming units uses the transparent developer having the softening point higher than that of the color developer used in the other of the image forming units, and having the average particle size larger than that of the color developer, the transparent developer does not melt at a temperature at which the color developer melts. Accordingly, after the fixing unit fixes the developer laminated portion, an image does not have a smooth surface and has an undulated surface.

In other word, it is possible to select an image with high gloss or a matte image with low gloss through selecting of a use of the transparent developer. Further, it is possible to make a structure of a transportation path of the medium and a structure of the image forming apparatus. Accordingly, it is possible to effectively cool the image forming apparatus, thereby preventing a temperature inside the image forming apparatus from increasing. As a result, it is possible to prevent problems such as hot offset or uneven fixing in the fixing unit, thereby improving image quality.

DETAILED DESCRIPTION OF THE PREFERRED EMBODIMENTS

Hereunder, embodiments of the present invention will be described in detail with reference to the accompanying drawings. In the following description, a printer will be explained as an image forming apparatus.

First Embodiment

Figure 1:
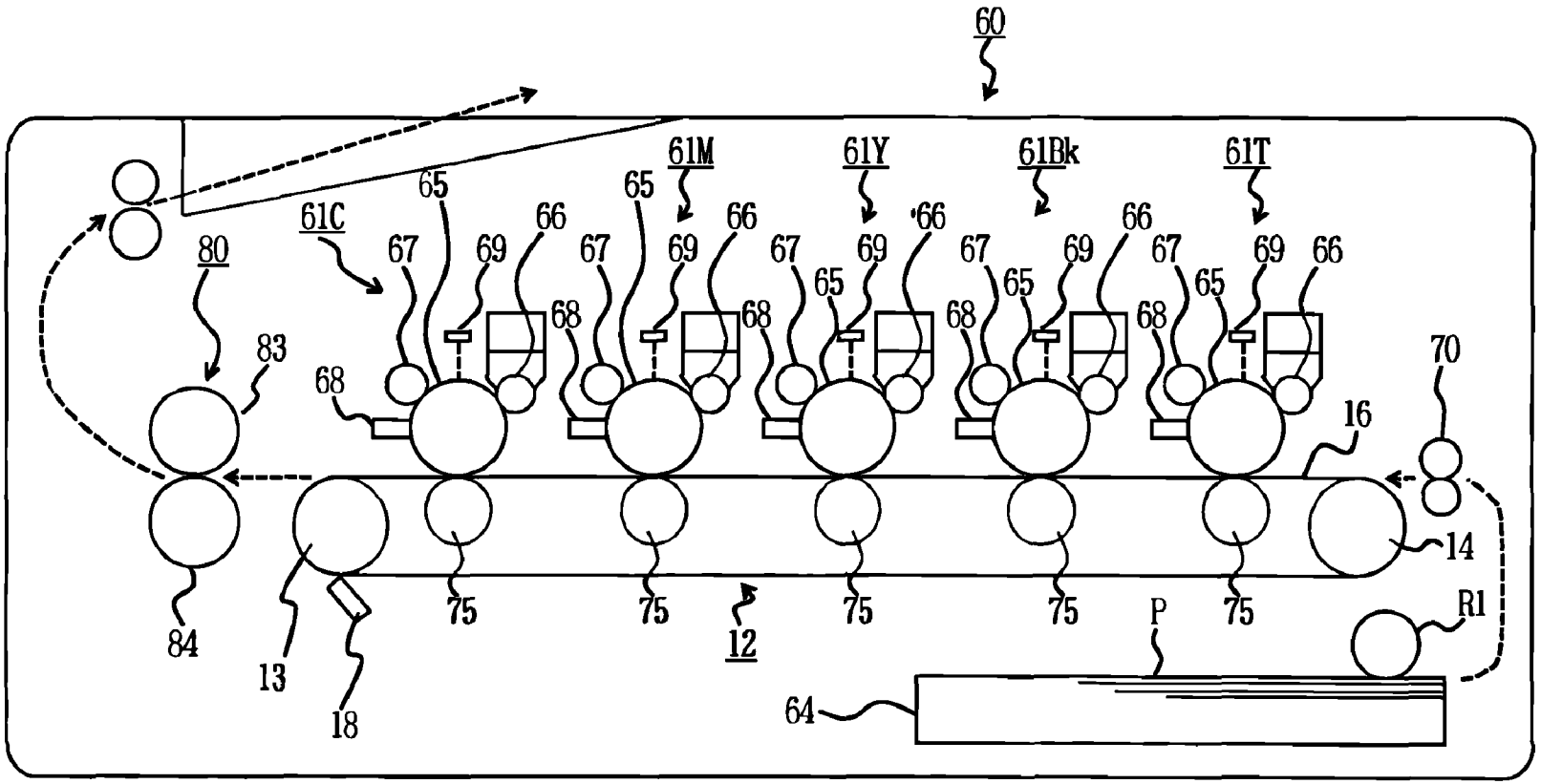
FIG. 1 is a schematic view showing a printer according to a first embodiment of the present invention.
Figure 2:
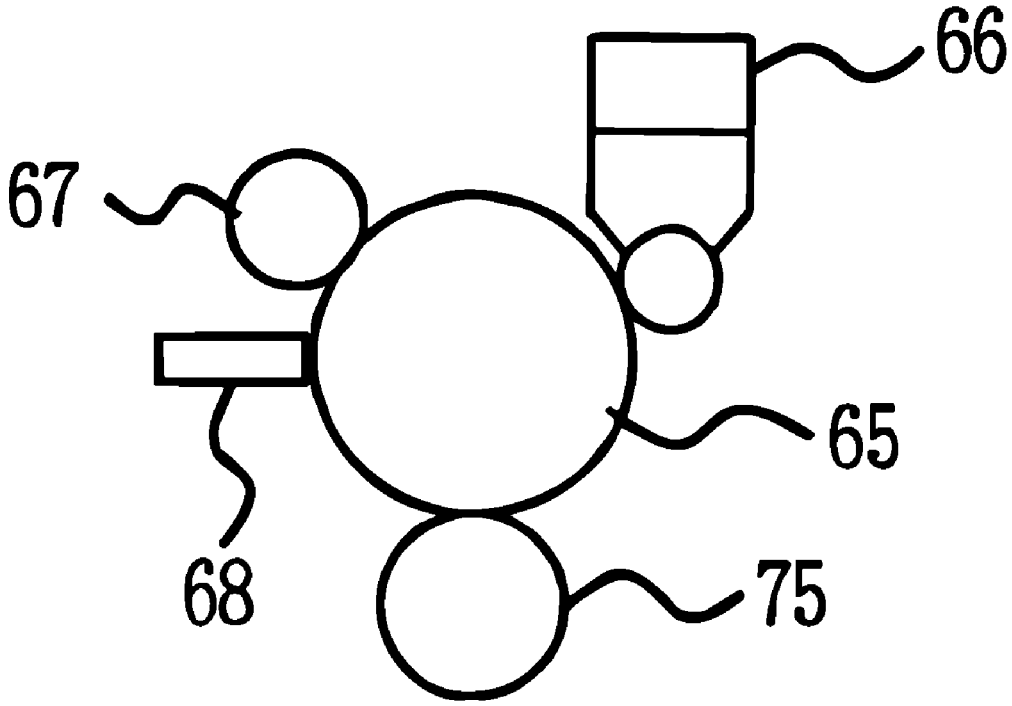
FIG. 2 is a schematic view showing an image forming unit according to the first embodiment of the present invention.

A first embodiment of the present invention will be explained. FIG. 1 is a schematic view showing a printer 60 according to the first embodiment of the present invention. FIG. 2 is a schematic view showing an image forming unit according to the first embodiment of the present invention.

As shown in FIG. 1, the printer 60 includes a plurality of image forming units 61T, 61B*k*, 61Y, 61M, and 61C for forming a transparent toner image as a transparent developer image and color toner images as color developer images in black, yellow, magenta, and cyan. The printer 60 also includes a transfer unit 12 of a belt type for transferring and overlapping the toner images in each color formed on photosensitive drums 65 as image supporting members to a sheet P, thereby forming a color toner image on the sheet P. The transfer unit 12 is disposed to face the photosensitive drums 65 of the image forming units 61T, 61B*k*, 61Y, 61M, and 61C, so that a transfer area of each color is formed between the transfer unit 12 and the photosensitive drums 65.

In the embodiment, the printer 60 further includes LED (Light Emitting Diode) heads 69 as exposure devices disposed to face the photosensitive drums 65 of the image forming units 61T, 61B*k*, 61Y, 61M, and 61C for exposing surfaces of the photosensitive drums 65 to form static latent images. The printer 60 also includes a sheet supply cassette 64 as a medium storage unit for storing the sheet P; a register roller 70 as a transportation member for transporting the sheet P picked up with a sheet supply roller R1 as a sheet supply member from the sheet supply cassette 64 to the transfer areas according to an image forming timing in the image forming units 61T, 61B*k*, 61Y, 61M, and 61C; and a fixing unit 80 as a fixing device for fixing the color toner image transferred in the transfer areas to the sheet P.

In the embodiment, the fixing unit 80 includes a heating roller 83 as a first rotational member and a pressing roller 84 as a second rotational member. The image forming unit 61T is disposed on an upstream side of the image forming units 61B*k*, 61Y, 61M, and 61C in a transportation direction (a moving direction) of the sheet P.

In the embodiment, the image forming units 61T, 61B*k*, 61Y, 61M, and 61C have an identical configuration. That is, each of the image forming units 61T, 61B*k*, 61Y, 61M, and 61C includes the photosensitive drum 65 arranged to be freely rotatable; a charge roller 67 as a charge device arranged to be rotatable in a forward direction relative to a rotational direction of the photosensitive drum 65 for uniformly charging the surface of the photosensitive drum 65; a developing roller 66 as a developer supporting member for developing the static latent image formed with the LED head 69 to form the toner image; and a cleaning blade 68 as a first cleaning member constituting a cleaning device.

In the embodiment, the transfer unit 12 includes a drive roller 13 as a first roller connected to a motor (not shown) as a transfer drive portion for rotating upon receiving a rotation of the motor; an idle roller 14 as a second roller for rotating while following the rotation of the drive roller 13; an endless belt 16 as a transfer belt or a belt placed between the drive roller 13 and the idle roller 14 to be movable; transfer rollers 75 as transfer members disposed inside the endless belt 16 to face the photosensitive drums 65 and be freely movable; and a cleaning blade 18 as a second cleaning member disposed near the drive roller 13 for abutting against an outer circumferential surface of the endless belt 16.

An operation of the printer 60 will be explained next. First, when a power switch (not shown) of the printer 60 is turned on and an operator starts an operation for forming an image, i.e., an operation for starting a printing operation, on a specific operational portion of a host device such as a personal computer, the personal computer sends print information and a print instruction to the printer 60.

When the personal computer sends the print information and the print instruction to the printer 60, a control unit (not shown) of the printer 60 drives a sheet supply motor (not shown) as a sheet supply drive portion. Accordingly, the sheet supply roller R1 rotates and picks up the sheet P, thereby starting a sheet supply operation.

In the next step, when the control unit drives a drum motor (not shown) as an image forming drive portion, the photosensitive drums 65 rotate, so that the charge rollers 67 charge the surfaces of the photosensitive drums 65. Then, the LED heads 69 expose the surfaces of the photosensitive drums 65, so that the static latent images are formed on the surfaces of the photosensitive drums 65 according to image data contained in the print information.

In the embodiment, the operator inputs information, so that a density or darkness of the static latent image is determined according to the information. Then, the developing rollers 66 attach toner as developer to the photosensitive drums 65, thereby developing the static latent images to form the toner images.

In the next step, while the endless belt 16 moves, the transparent toner image and the color toner images in black, yellow, magenta, and cyan are sequentially overlapped and transferred to the sheet P, thereby forming the color toner image constituting a developer laminated portion. Note that the transparent toner image is transferred to all areas where the color toner images are transferred.

In the embodiment, the print information includes print direction information for directing a printing operation of forming the transparent toner image with the image forming unit 61T to print an image with high gloss, i.e., a gloss printing operation, or for directing a printing operation of forming a matte image with low gloss, i.e., a matte printing operation.

When the matte printing operation is selected, the control unit analyzes the image data to create image data for reducing a gloss value indicating an extent of gloss of an image, so that the transparent toner image is formed in a specific area on the photosensitive drum 65 of the image forming unit 61T to reduce the gloss value. The specific area includes all of areas on the photosensitive drums 65 of the image forming units 61B*k*, 61Y, 61M, and 61C where the color toner images are formed.

In the next step, the control unit drives the LED head 69 of the image forming unit 61T according to the image data for reducing a gloss value to form the static latent image in the specific area. The developing roller 66 of the image forming unit 61T attaches transparent toner to the static latent image, thereby forming the transparent toner image.

Similarly, the control unit drives the LED heads 69 of the image forming units 61B*k*, 61Y, 61M, and 61C according to normal image data for forming the color toner images and maintaining a gloss value to form the static latent images in the areas where the color toner images are formed. The developing rollers 66 of the image forming units 61B*k*, 61Y, 61M, and 61C attach toner in each color (color toner) to the static latent images, thereby forming the color toner images. Accordingly, after the transparent toner image is transferred to the sheet P, the color toner images are overlapped and transferred to the sheet P.

When the gloss printing operation is selected, the control unit does not create the image data for reducing a gloss value, and creates only the normal image data. Accordingly, the control unit does not drive the LED head 69 of the image forming unit 61T, and the developing roller 66 of the image forming unit 61T does not form the transparent toner image. The developing rollers 66 of the image forming units 61B*k*, 61Y, 61M, and 61C attach toner in each color (color toner) to the static latent images, thereby forming the color toner images. Accordingly, only the color toner images are overlapped and transferred to the sheet P.

In the next step, the sheet P is transported to the fixing unit 80, so that the fixing unit 80 fixes the toner images to the sheet P through heating and pressing. After the fixing unit 80 fixes the toner images, the sheet P is discharged outside the printer 60.

In the embodiment, after the toner images are transferred, the cleaning blade 68 scraps off toner remaining on the photosensitive drums 65. After the fixing unit 80 fixes the toner images, the cleaning blade 18 scrapes off toner remaining on the endless belt 16.

The transparent toner described above will be explained next. In the embodiment, the transparent toner is formed of particles made of a transparent resin such as a compound of a polyester resin. A surface of the particle is coated with a film formed of wax the same as that used in color toner at a weight % equal to or greater than 5 weight % or equal to or less than 10 weight %.

In the embodiment, the polyester resin does not melt at a fixing temperature of the fixing unit 80 equal to or greater than 160° C. or equal to or less than 180° C., thereby not forming a film. That is, the polyester resin has a softening temperature higher than that of the color toner by more than 40° C. Further, the polyester resin has a transmittance of visible light of more than 75%. Instead of the polyester resin, other materials may be used, as far as the material does not melt at a fixing temperature of the fixing unit 80 equal to or greater than 160° C. or equal to or less than 180° C., thereby not forming a film. That is, the material has a softening temperature higher than that of the color toner by more than 40° C. Further, the material has a transmittance of visible light of more than 75%.

When the polyester resin having a transmittance of visible light of more than 75%, even when the transparent toner is overlapped with the color toner, it is possible to minimize an influence on color tone of the toner image of the color toner.

In the embodiment, the transparent toner has a particle size or a volume particle size equal to or greater than 8 μm or equal to or less than 35 μm, and an average particle size D50 equal to or greater than 14 μm or equal to or less than 22 μm. Note that the volume particle size and the average particle size D50 may be measured using Multisizer 3 (a product of Beckman Coulter Inc.) through Coulter counter method.

In the embodiment, a volume particle size ratio dv of the transparent toner to the color toner (the volume particle size of the transparent toner/the volume particle size of the color toner) satisfies the following relationship:

$$1 \leqq dv \leqq 5$$

In this case, the volume particle size of the color toner is equal to or greater than 6.5 μm or equal to or less than 7.5 μm.

In the embodiment, the softening temperature is defined as a temperature at which a material in converted to a linear shape under a pressure of 1.96 MPa.

In general, a melting point and a boiling point tend to increase under pressure. When the fixing temperature of the fixing unit 80 is set equal to or greater than 160° C. or equal to or less than 180° C., the color toner such as Px723 type having a softening temperature of 114° C. is used. Accordingly, when pressure is applied in the fixing unit 80, the color toner melts.

On the other hand, the transparent toner has a softening temperature higher than that of the color toner, so that the transparent toner does not melt under pressure in the fixing unit 80. Accordingly, the transparent toner has a softening temperature equal to or greater than 160° C., i.e. a lower limit of a set range of the fixing temperature. Note that the transparent toner has a melting point higher than that of the color toner by more than 20° C.

As described above, when the sheet P is transported while being pressed in the fixing unit 80, the transparent toner does not melt, so that the color toner image is fixed to the sheet P without deforming a shape thereof. The transparent toner has the volume particle size greater than a thickness of a layer of the color toner, thereby creating an undulation in a surface of the color toner image. Accordingly, a flatness of the color image is lowered, thereby reducing the gloss value thereof.

A mechanism of reducing the gloss value will be explained next. In general, a gloss value of an image is proportional to an amount of color toner attached to the sheet P per dot. Accordingly, in the following description, in order to explain the mechanism of reducing the gloss value, there was conducted an experiment in which color toner with high gloss was used and an image was formed at a density of 100%.

Figure 3:
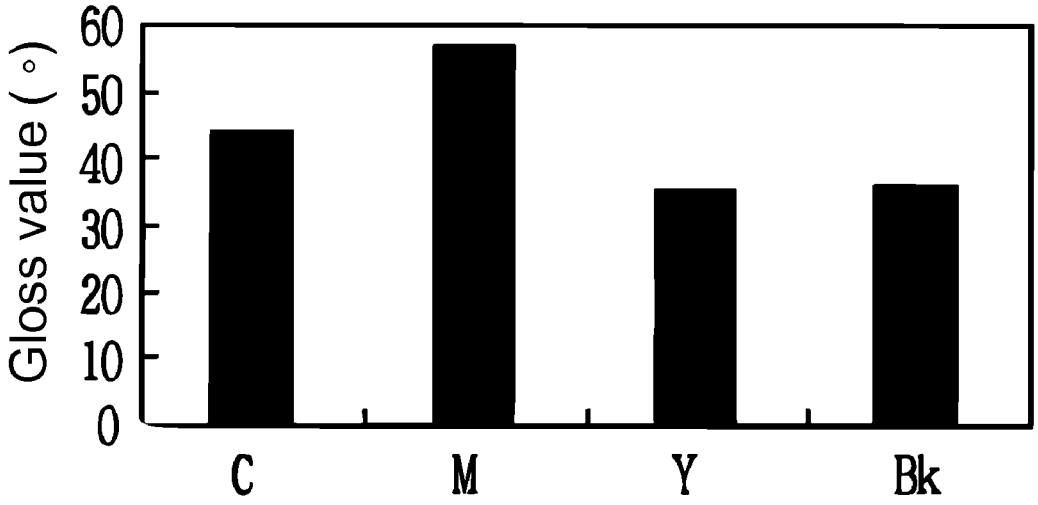
FIG. 3 is a graph showing a gloss value of toner according to the first embodiment of the present invention.
Figure 4:
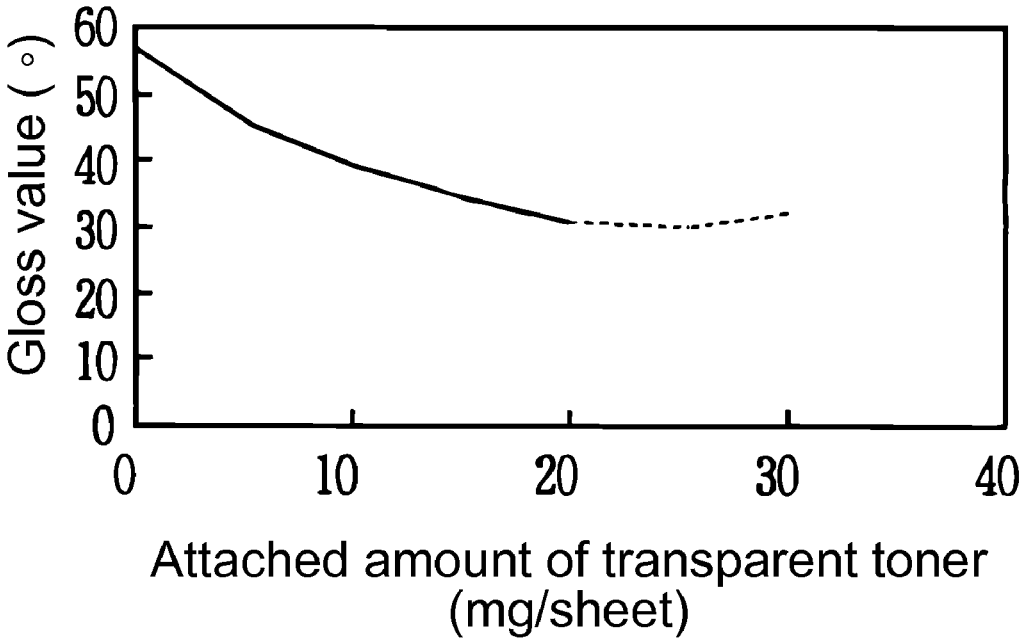
FIG. 4 is a graph showing a relationship between a gloss value and an attached density of transparent toner according to the first embodiment of the present invention.

FIG. 3 is a graph showing the gloss value of the toner in each color according to the first embodiment of the present invention. FIG. 4 is a graph showing a relationship between the gloss value and an attached density of the transparent toner according to the first embodiment of the present invention.

In FIG. 3, the horizontal axis represents each color, i.e., black, yellow, magenta, and cyan, and the vertical axis represents the gloss value. In FIG. 4, the horizontal axis represents the attached density of the transparent toner, and the vertical axis represents the gloss value.

When the color toner in black, yellow, magenta, and cyan, was used to form an image with a density of 100%, the color toner in magenta provided the highest gloss value as shown in FIG. 3. When the color toner in magenta was used and the transparent toner was attached, and an image with a density of 100% was formed on the sheet P having an A4 size, the relationship between the gloss value and an attached density of the transparent toner is shown in FIG. 4 and Table 1. Note that the gloss value was measured according to JIS P8142.

TABLE 1

| Attached density | 0 | 5 | 10 | 15 | 20 | 25 | 30 |
|---|---|---|---|---|---|---|---|
| Gloss value | 57 | 46 | 39 | 34 | 31 | 30 | 32 |

As shown in FIG. 4 and Table 1, when the attached density of the transparent toner increases, the gloss value decreases. When the attached density of the transparent toner becomes greater than a specific value (25 mg/sheet), however, the gloss value increases. This is because when the attached density of the transparent toner became greater than a specific value, a smooth surface was created with the transparent toner itself. Further, wax contained in the transparent toner moved up to a surface of the image.

According to the result described above, in the embodiment, in order to reduce the gloss value, the attached density of the transparent toner is set greater than 0.5 mg/sheet and less than 25 mg/sheet.

The volume particle size of the transparent toner will be explained next. In an experiment, a laser microscope was used to measure a thickness of an image (fixed layer) of the color toner in a text portion representing a line, a text, and the likes, and in an image portion representing a figure, a scene, and the likes. It was found that the thickness was equal to or greater than 4 μm or equal to or smaller than 22 μm. Accordingly, a lower limit of the volume particle size of the transparent toner is set 8 μm, considering an effect of forming an undulation in an image.

Further, in another experiment, the transparent toner having various volume particle sizes was fixed to the sheet P, and a state of fixing was evaluated. Table 2 shows a result of the experiment.

TABLE 2

| | volume particle size of transparent toner (μm) | | | | | |
|---|---|---|---|---|---|---|
| | ~10 | ~20 | ~30 | ~35 | ~40 | ~50 |
| Fixing state | Normal | Normal | Normal | Normal | Partially missing | Missing |

As shown in Table 2, when the volume particle size of the transparent toner is equal to or smaller than 35 μm, it is possible to fix the image normally. When the volume particle size of the transparent toner becomes greater than 35 μm and smaller than 40 μm, the transparent toner is partially missing from the image. When the volume particle size of the transparent toner becomes greater than 40 μm, the transparent toner is mostly missing from the image. Accordingly, an upper limit of the volume particle size of the transparent toner is set at 35 μm.

Accordingly, when the volume particle size of the color toner is equal to or greater than 6.5 μm or equal to or less than 7.5 μm, it is possible to maintain the volume particle size ratio dv within the following relationship:

$$1 \leqq dv \leqq 5$$

When the volume particle size ratio dv is smaller than one, that is, the volume particle size of the transparent toner is smaller than the volume particle size of the color toner, the transparent toner tends to be embedded in the color toner. Accordingly, it is difficult to form an undulation in an image and lower a flatness of the image, thereby making it difficult to reduce the gloss value.

When the volume particle size of the color toner is equal to or greater than 6.0 μm or equal to or less than 8.0 μm, it is possible to normally fix the image when the volume particle size ratio dv is within the following relationship:

$$1 \leqq dv \leqq 5$$

When the volume particle size of the color toner is smaller than 6.0 μm, an upper limit of the volume particle size ratio dv increases, and the volume particle size ratio dv is within the following relationship:

$$1 \leqq dv \leqq 7$$

For example, when the volume particle size of the color toner is 5.0 μm, the upper limit of the volume particle size of the transparent toner becomes 35 μm. Up to the upper limit, it is possible to normally fix the image. This is because even when the volume particle size of the color toner decreases, a thickness of a toner layer in an image does not decrease to a large extent after fixing the image.

Figure 5:
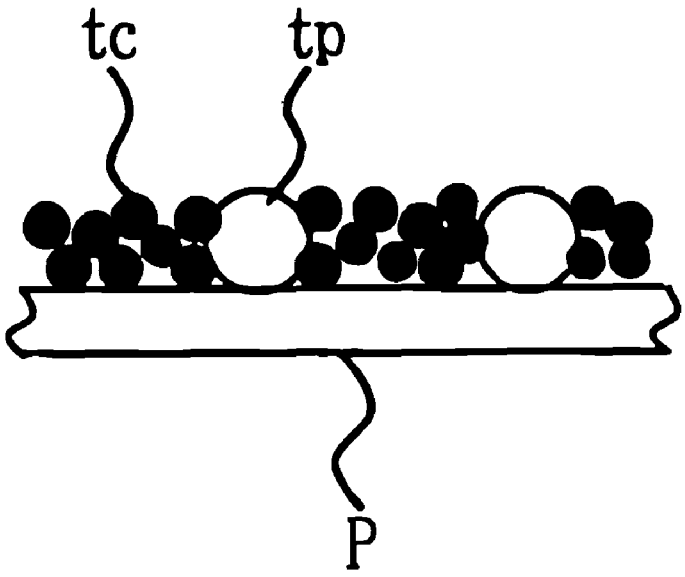
FIG. 5 is a schematic view showing a toner image before the toner image is fixed according to the first embodiment of the present invention.
Figure 6:
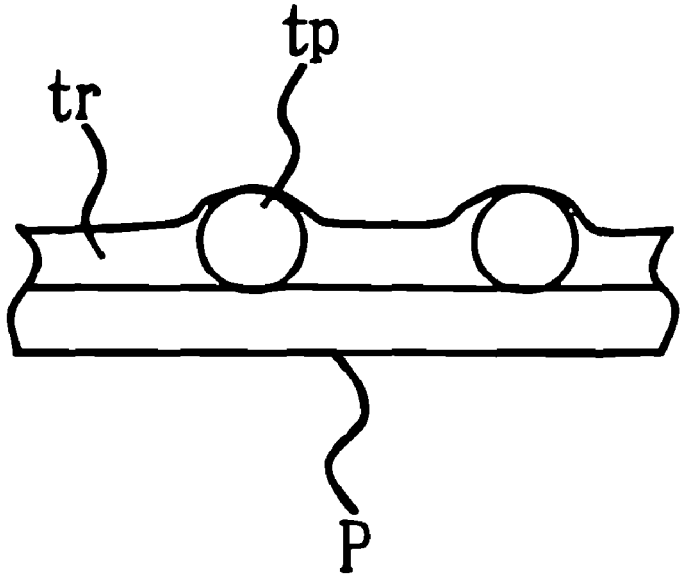
FIG. 6 is a schematic view showing the toner image after the toner image is fixed according to the first embodiment of the present invention.

A change in a state of the toner image before and after the toner image is fixed will be explained next. FIG. 5 is a schematic view showing the toner image before the toner image is fixed according to the first embodiment of the present invention. FIG. 6 is a schematic view showing the toner image after the toner image is fixed according to the first embodiment of the present invention.

As shown in FIG. 5, transparent toner tp is attached to color toner tc to form the toner image. When the toner image is fixed, as shown in FIG. 6, the color toner tc melts to form a toner layer tr as a developer layer. On the other hand, the transparent toner tp does not melt. Accordingly, after the toner image is fixed, a surface of the toner image does not become smooth and has undulation. As a result, a gloss value of the surface lowers, but visibility of a portion where the transparent toner tp is attached is not lowered due to light beam.

Further, as shown in FIG. 5, when the transparent toner tp is attached to the sheet P before the color toner tc is attached to the sheet P, the transparent toner tp is embedded in a layer of the color toner tc (the transparent toner tp is covered with the layer of the color toner tc). Accordingly, it is possible to firmly attach the transparent toner tp to the sheet P, thereby preventing the transparent toner tp from coming off from the sheet P.

As described above, in the embodiment, in addition to the image forming units 61B*k*, 61Y, 61M, and 61C, the image forming unit 61T is provided. Accordingly, it is possible to form both the image with high gloss and the matte mage with low gloss. As a result, it is not necessary to provide a plurality of the image forming units and a plurality of the fixing devices, thereby making the transportation path of the sheet P and the configuration of the printer simple. Accordingly, it is possible to prevent a temperature inside the printer from increasing, and to prevent problems such as hot offset or uneven fixing in the fixing unit 80, thereby improving image quality.

Second Embodiment

A second embodiment of the present invention will be explained next. Components in the second embodiment similar to those in the first embodiment are designated with the same reference numerals, and explanations thereof are omitted. Explanations of operations and effects in the second embodiment similar to those in the first embodiment are omitted.

Figure 7:
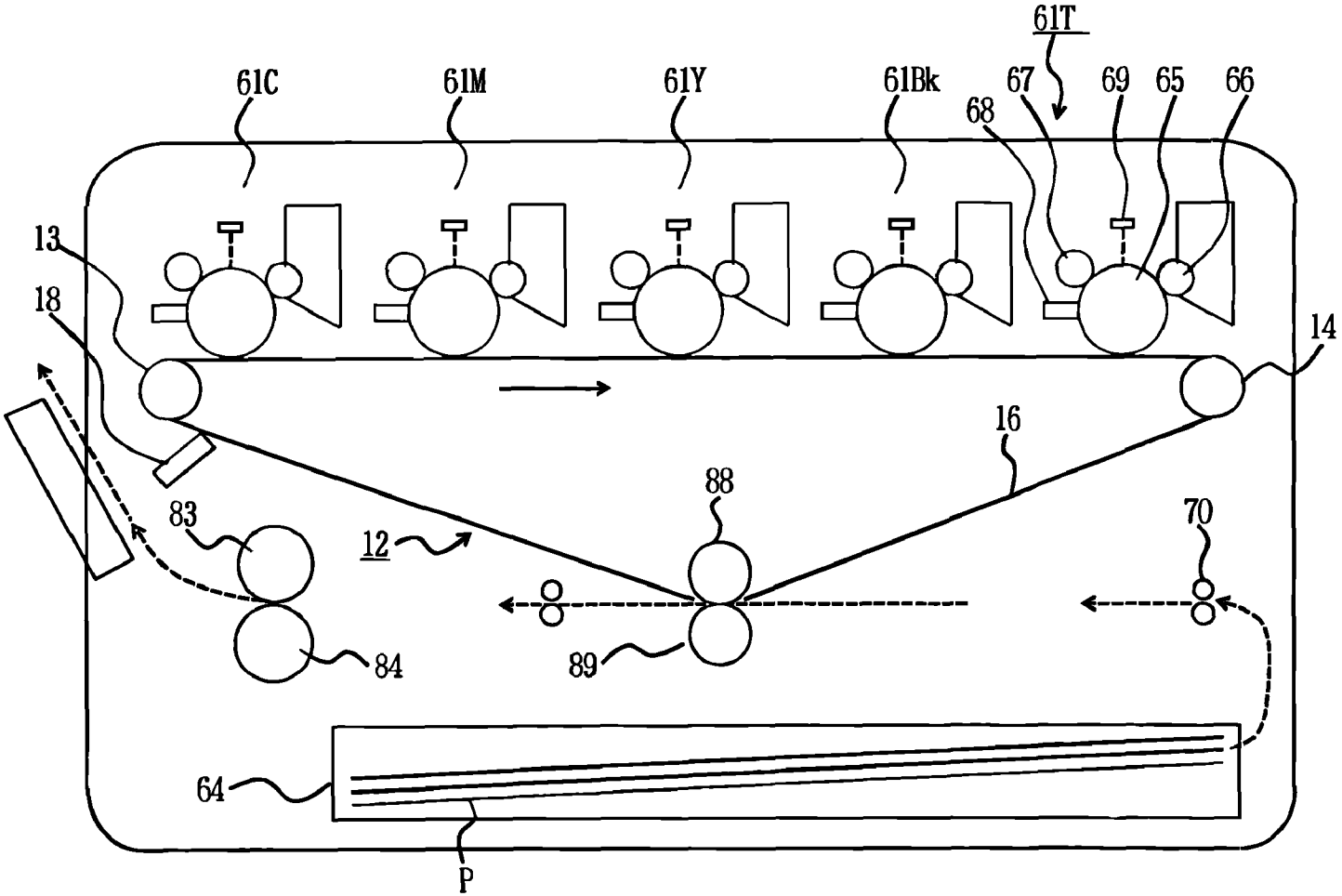
FIG. 7 is a schematic view showing a printer according to a second embodiment of the present invention.

FIG. 7 is a schematic view showing a printer according to the second embodiment of the present invention.

In the embodiment, the endless belt 16 as a first transfer member is placed between the drive roller 13 as a first roller, the idle roller 14 as a second roller, and a tension roller 88 as a third roller to be movable in an arrow direction. The endless belt 16 functions as an intermediate transfer member representing an intermediate medium. That is, the developer images are directly overlapped and transferred to the endless belt 16, thereby forming the color toner images as the developer laminated portion.

In the embodiment, the tension roller 88 and a transfer roller 89 as a second transfer member are disposed to sandwich the endless belt 16, so that the sheet P as a medium is transported between the endless belt 16 and the transfer roller 89. Note that the drive roller 13, the idle roller 14, the tension roller 88, the endless belt 16, and the transfer roller 89 constitute the transfer unit 12 of a belt type.

In the embodiment, the endless belt 16 moves in the arrow direction along the image forming units 61C, 61M, 61Y, 61B*k*, and 61T, so that the toner images in cyan, magenta, yellow, and black and the transparent toner image are directly overlapped and transferred to the endless belt 16, thereby forming the color toner images on the endless belt 16.

In the next step, the transfer roller 89 transfers the color toner images to the sheet P. At this moment, the transfer roller 89 contacts with the sheet P from a lower portion thereof to an upper portion thereof. Accordingly, the transparent toner image and the toner images in black, yellow, magenta, and cyan are collectively transferred in an overlapped state to the sheet P from the lower portion thereof to the upper portion thereof.

In the embodiment, after the color toner is attached to the endless belt 16, the transparent toner is attached to the endless belt 16. Accordingly, the transparent toner is transferred to the sheet P such that the transparent toner is embedded into a layer of the color toner (the transparent toner is covered with the layer of the color toner). As a result, it is possible to improve adhesion between the sheet P and the transparent toner and prevent the transparent toner from coming off from the sheet P.

After the color toner images are transferred to the sheet, the cleaning blade 18 as the second cleaning member remove toner remaining on the endless belt 16.

As described above, in the embodiment, after the toner images are developed and formed, it is possible to transfer the toner images to the sheet P after the toner images are transferred to the endless belt 16.

Third Embodiment

A third embodiment of the present invention will be explained next. Components in the third embodiment similar to those in the first and second embodiments are designated with the same reference numerals, and explanations thereof are omitted. Explanations of operations and effects in the third embodiment similar to those in the first and second embodiments are omitted.

Figure 8:
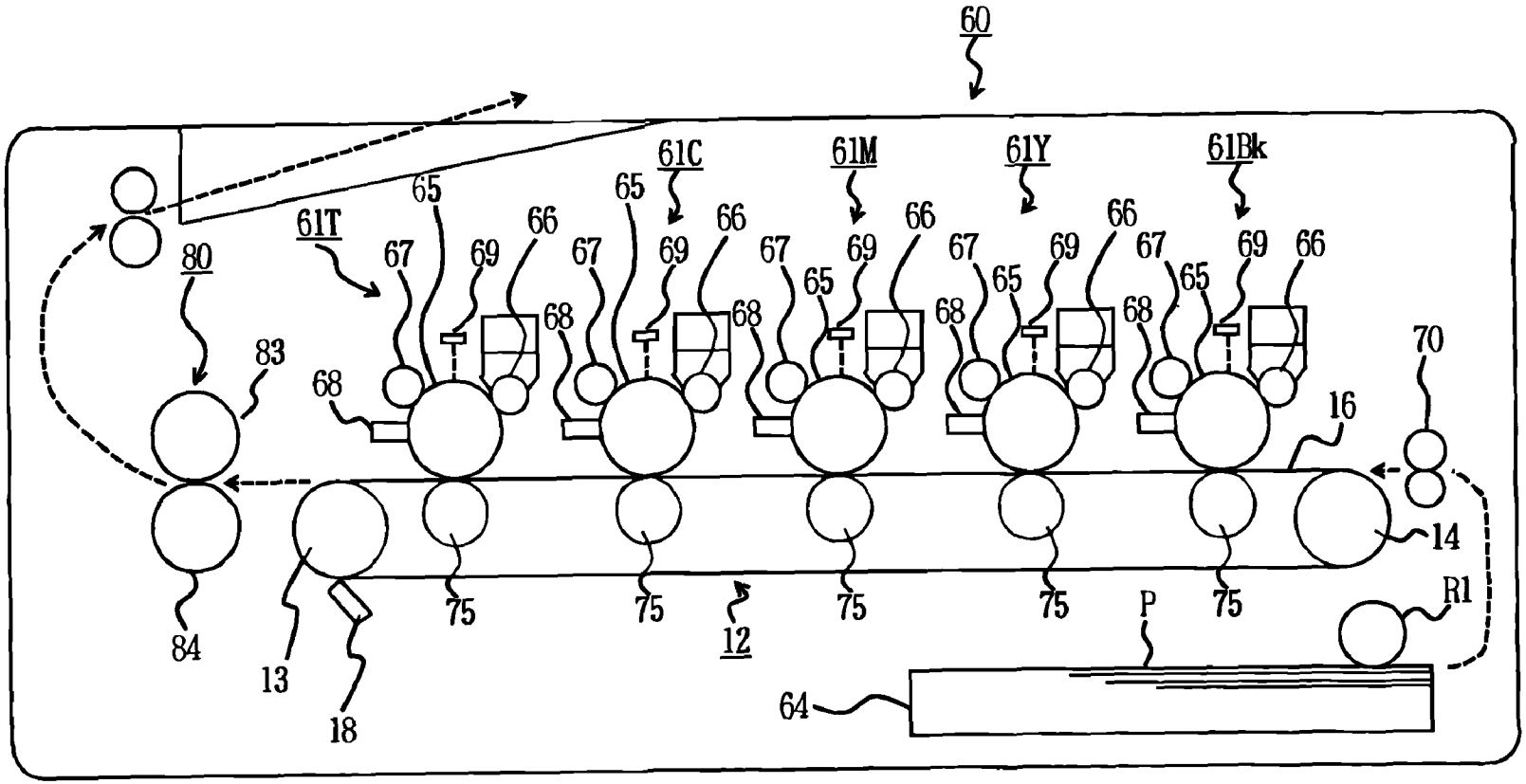
FIG. 8 is a schematic view showing a printer according to a third embodiment of the present invention.

FIG. 8 is a schematic view showing the printer 60 according to the third embodiment of the present invention.

In the embodiment, the image forming unit 61T of the transparent toner is disposed on a downstream side of the image forming units 61B*k*, 61Y, 61M, and 61C in the transportation direction (the moving direction) of the sheet P as the medium.

An operation of the printer will be explained next.

When the matte printing operation is selected, the control unit (not shown) of the printer 60 drives the LED heads 69 of the image forming units 61B*k*, 61Y, 61M, and 61C according to normal image data for forming the color toner images and maintaining a gloss value to form the static latent images in areas where the color toner images are formed. The developing rollers 66 of the image forming units 61B*k*, 61Y, 61M, and 61C attach toner in each color (color toner) to the static latent images, thereby forming the color toner images.

In the next step, the control unit drives the LED head 69 of the image forming unit 61T according to the image data for reducing a gloss value to form the static latent image in a specific area. The developing roller 66 of the image forming unit 61T attaches the transparent toner to the static latent image, thereby forming the transparent toner image.

Accordingly, in the embodiment, after the color toner images in each color are overlapped and transferred to the sheet P, the transparent toner image is overlapped and transferred to the sheet P, thereby forming the developer laminated portion.

As described above, in the embodiment, after the color toner images in each color are overlapped and transferred to the sheet P, the transparent toner image is overlapped and transferred to the sheet P, thereby forming the developer laminated portion. Accordingly, when the color toner images in each color are transferred, the transparent toner is not embedded into a layer of the color toner. As a result, the toner images in each color are not disturbed, thereby preventing image quality from lowering.

Third Embodiment

A fourth embodiment of the present invention will be explained next. Components in the fourth embodiment similar to those in the first to third embodiments are designated with the same reference numerals, and explanations thereof are omitted. Explanations of operations and effects in the fourth embodiment similar to those in the first to third embodiments are omitted.

Figure 9:
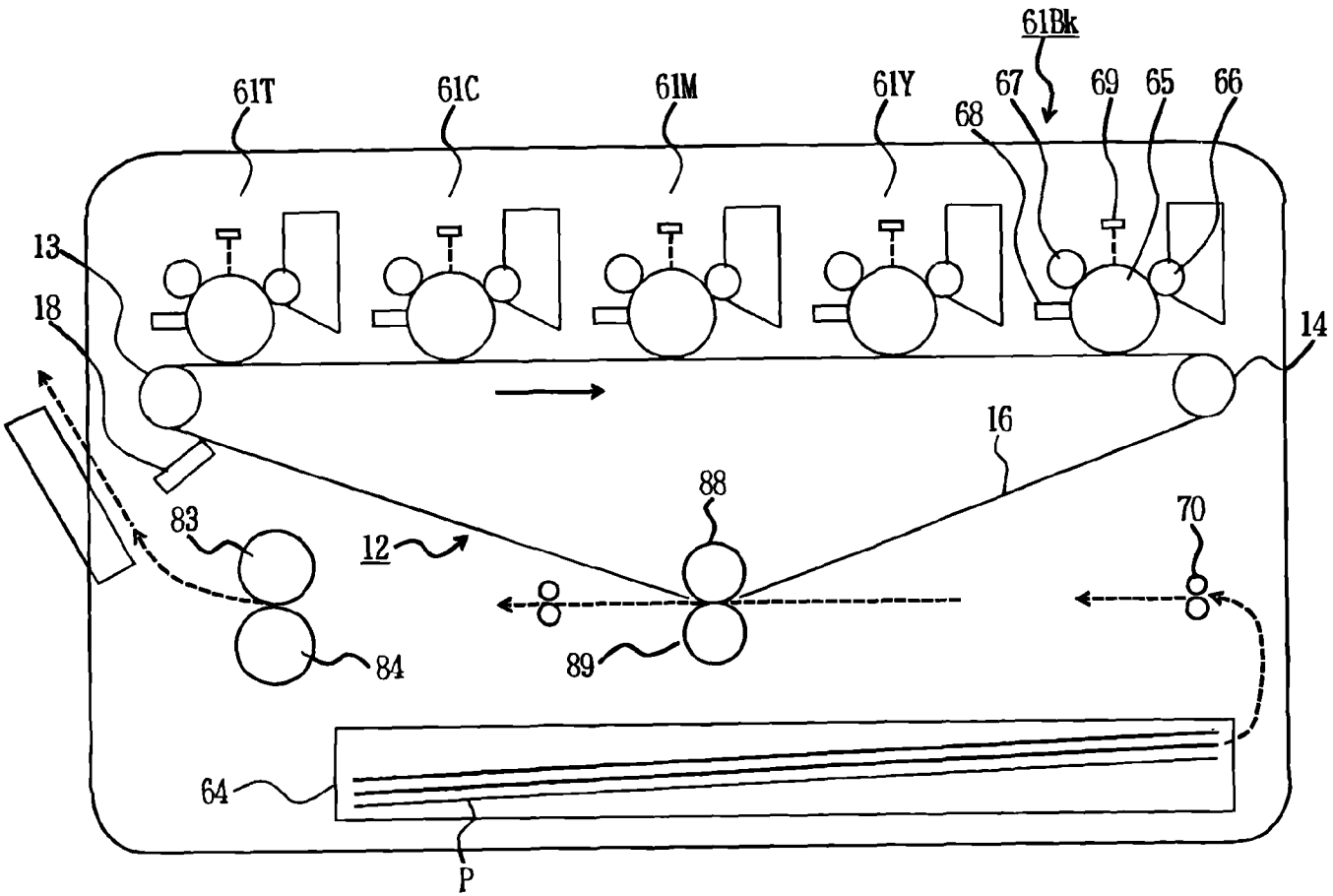
FIG. 9 is a schematic view showing a printer according to a fourth embodiment of the present invention.

FIG. 9 is a schematic view showing a printer according to the fourth embodiment of the present invention.

In the embodiment, the endless belt 16 moves in the arrow direction along the image forming units 61T, 61C, 61M, 61Y, and 61B*k*, so that the transparent toner image and the toner images in cyan, magenta, yellow, and black are directly overlapped and transferred to the endless belt 16, thereby forming the color toner images on the endless belt 16.

In the embodiment, the endless belt 16 functions as an intermediate transfer member representing an intermediate medium. That is, the developer images are directly overlapped and transferred to the endless belt 16, thereby forming the color toner images as the developer laminated portion.

In the next step, the transfer roller 89 as the second transfer member transfers the color toner images to the sheet P. At this moment, the transfer roller 89 contacts with the sheet P from a lower portion thereof to an upper portion thereof. Accordingly, the toner images in black, yellow, magenta, and cyan and the transparent toner image are collectively transferred in an overlapped state to the sheet P from the lower portion thereof to the upper portion thereof.

In the embodiment, after the transparent toner image is transferred to the endless belt 16, the color toner images are transferred to the endless belt 16. Accordingly, the transparent toner image is transferred to the sheet P such that the transparent toner image covers a layer of the color toner images. As a result, it is possible to improve adhesion between the sheet P and the transparent toner and prevent the transparent toner from coming off from the sheet P. Accordingly, the transparent toner is not embedded into a layer of the color toner. As a result, the toner images in each color are not disturbed, thereby preventing image quality from lowering.

In the embodiments described above, the present invention is applied to the printer as the image forming apparatus, and may be applicable to a copier, a facsimile, and a multifunction product using a belt unit.

The disclosure of Japanese Patent Application No. 2007-251389, filed on Sep. 27, 2007, is incorporated in the application by reference.

While the invention has been explained with reference to the specific embodiments of the invention, the explanation is illustrative and the invention is limited only by the appended claims.

What is claimed is:

1. An image forming apparatus comprising:

a first image forming unit for forming a color developer image using color developer;

a second image forming unit for forming a transparent developer image using transparent developer;

a transfer unit for transferring the transparent developer image and the color developer image to a medium;

a fixing unit for fixing the transparent developer image and the color developer image; and a control unit for controlling the first image forming unit and the second image forming unit to form the transparent developer image and the color developer image when the control unit is directed to reduce a gloss value.

2. The image forming apparatus according to claim 1, wherein said control unit is arranged to determine whether a gloss printing operation or a matte printing operation is selected, said control unit being arranged to control the first image forming unit and the second image forming unit according to the matte printing operation when the matte printing operation is selected.

3. The image forming apparatus according to claim 2, wherein said control unit is arranged to control the first image forming unit to form the color developer image when the gloss printing operation is selected, said control unit being arranged to control the first image forming unit to form the color developer image and the second image forming unit to form the transparent developer image when the matte printing operation is selected.

4. The image forming apparatus according to claim 1, wherein said control unit is arranged to control the second image forming unit to form the transparent developer image in a specific area and the first image forming unit to form the color developer image in the specific area.

5. The image forming apparatus according to claim 1, wherein said control unit is arranged to control the first image forming unit to form the color developer image in a specific area and the second image forming unit to form the transparent developer image in the specific area so that the transparent developer image is overlapped over the color developer image when the color developer image and the transparent developer image are transferred to the medium.

6. The image forming apparatus according to claim 1, wherein said control unit is arranged to control the second image forming unit to form the transparent developer image in a specific area and the first image forming unit to form the color developer image in the specific area so that the color developer image is overlapped over the transparent developer image when the transparent developer image and the color developer image are transferred to the medium.

7. The image forming apparatus according to claim 1, wherein said control unit is arranged to control the second image forming unit to form the transparent developer image so that the transparent developer image is transferred to a transfer medium, said control unit being arranged to control the first image forming unit to transfer the color developer image on the transparent developer image on the transfer medium before the transparent developer image and the color developer image are transferred to the medium.

8. The image forming apparatus according to claim 1, wherein said control unit is arranged to control the first image forming unit to form the color developer image so that the color developer image is transferred to a transfer medium, said control unit being arranged to control the second image forming unit to transfer the transparent developer image on the color developer image on the transfer medium before the color developer image and the transparent developer image are transferred to the medium.

9. The image forming apparatus according to claim 1, wherein said second image forming unit is arranged to form the transparent developer image using the transparent developer having a transmittance of visible light of more than 75%.

10. The image forming apparatus according to claim 1, wherein said second image forming unit is arranged to form the transparent developer image at an attached density of the transparent developer relative to the medium greater than 0.5 mg/sheet and less than 25 mg/sheet.

11. The image forming apparatus according to claim 1, wherein said second image forming unit is arranged to form the transparent developer image using the transparent developer having a volume particle size ratio dv of the transparent developer to the color developer satisfying the following relationship:

$$1 \leqq dv < 5.$$

12. The image forming apparatus according to claim 1, wherein said second image forming unit is arranged to form the transparent developer image using the transparent developer having a melting point higher than that of the color developer by more than 20° C.

13. The image forming apparatus according to claim 1, wherein said second image forming unit is arranged to form the transparent developer image using the transparent developer having an average particle size in a range between 8 μm and 35 μm.

14. The image forming apparatus according to claim 1, wherein said second image forming unit is arranged to form the transparent developer image using the transparent developer having a volume particle size ratio dv of the transparent developer to the color developer satisfying the following relationship when an average particle size of the color developer is less than 6 μm:

$$1 \leqq dv \leqq 7.$$

15. The image forming apparatus according to claim 1, wherein said second image forming unit is arranged to form the transparent developer image using the transparent developer having a softening point higher than a fixing temperature.

16. The image forming apparatus according to claim 1, wherein said second image forming unit is disposed on an upstream side of the first image forming unit in a direction that the medium is transported.

17. The image forming apparatus according to claim 1, wherein said second image forming unit is disposed on a downstream side of the first image forming unit in a direction that the medium is transported.

18. The image forming apparatus according to claim 1, wherein said second image forming unit is arranged to form an undulation with the transparent developer image when a matte printing operation is selected.

19. An image forming apparatus comprising:

a first image forming unit for forming a color developer image using color developer;

a second image forming unit for forming a transparent developer image using transparent developer;

a transfer unit for transferring the transparent developer image and the color developer image to a medium;

a fixing unit for fixing the transparent developer image and the color developer image; and a control unit for controlling the first image forming unit and the second image forming unit according to a gloss printing operation when the gloss printing operation is selected, wherein said control unit is arranged to determine whether the gloss printing operation or a matte printing operation is selected, said control unit being arranged to control the first image forming unit and the second image forming unit according to the matte printing operation when the matte printing operation is selected, and said control unit is arranged to control the first image forming unit to form the color developer image when the gloss printing operation is selected, said control unit being arranged to control the first image forming unit to form the color developer image and the second image forming unit to form the transparent developer image when the matte printing operation is selected.

20. An image forming apparatus comprising:

a first image forming unit for forming a color developer image using color developer;

a second image forming unit for forming a transparent developer image using transparent developer;

a transfer unit for transferring the transparent developer image and the color developer image to a medium;

a fixing unit for fixing the transparent developer image and the color developer image; and a control unit for controlling the first image forming unit and the second image forming unit according to a gloss printing operation when the gloss printing operation is selected, wherein said second image forming unit is arranged to form the transparent developer image using the transparent developer having a melting point higher than that of the color developer by more than 20° C.

21. An image forming apparatus comprising:

a first image forming unit for forming a color developer image using color developer;

a second image forming unit for forming a transparent developer image using transparent developer;

a transfer unit for transferring the transparent developer image and the color developer image to a medium;

a fixing unit for fixing the transparent developer image and the color developer image; and a control unit for controlling the first image forming unit and the second image forming unit according to a gloss printing operation when the gloss printing operation is selected, wherein said second image forming unit is arranged to form the transparent developer image using the transparent developer having a softening point higher than a fixing temperature.

* * * * *